US008291731B2

(12) United States Patent
Jeong et al.

(10) Patent No.: US 8,291,731 B2
(45) Date of Patent: Oct. 23, 2012

(54) WASHING MACHINE GENERATING AND USING THE STEAM

(75) Inventors: Seong Hai Jeong, Changwon-si (KR); Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 710 days.

(21) Appl. No.: 11/629,347

(22) PCT Filed: Mar. 31, 2006

(86) PCT No.: PCT/KR2006/001180

§ 371 (c)(1),
(2), (4) Date: Feb. 5, 2009

(87) PCT Pub. No.: WO2006/129912

PCT Pub. Date: Dec. 7, 2006

(65) Prior Publication Data

US 2009/0272155 A1 Nov. 5, 2009

(30) Foreign Application Priority Data

May 31, 2005 (KR) ..... 10-2005-0046031
May 31, 2005 (KR) ..... 10-2005-0046032

(51) Int. Cl.
*D06F 33/02* (2006.01)
*D06F 39/04* (2006.01)

(52) U.S. Cl. ..... 68/12.05; 68/12.22; 68/15

(58) Field of Classification Search ..... 68/12.05, 68/15, 12.12, 12.19, 12.21, 12.22, 23 R
See application file for complete search history.

(56) References Cited

U.S. PATENT DOCUMENTS

| | | | | |
|---|---|---|---|---|
| 5,233,718 | A * | 8/1993 | Hardaway et al. | 8/158 |
| 5,394,582 | A * | 3/1995 | Moon | 8/158 |
| 2004/0187529 | A1* | 9/2004 | Kim et al. | 68/207 |
| 2005/0034250 | A1* | 2/2005 | Oh et al. | 8/159 |
| 2005/0092035 | A1 | 5/2005 | Shin et al. | |
| 2005/0155393 | A1* | 7/2005 | Wright et al. | 68/3 R |

FOREIGN PATENT DOCUMENTS

| | | | |
|---|---|---|---|
| CN | 1580369 | A | 2/2005 |
| CN | 1614118 | | 5/2005 |
| EP | 1 275 767 | A1 | 1/2003 |
| EP | 1507031 | A1 | 2/2005 |
| JP | 5023493 | A | 2/1993 |
| KR | 10-2000-0002187 | | 1/2000 |
| KR | 10-2001-0018295 | | 3/2001 |
| KR | 10-2002-0057119 | | 7/2002 |
| KR | 10-2003-0074202 | | 9/2003 |
| KR | 10-2004-0095057 | | 11/2004 |
| KR | 10-2005-0017489 | | 2/2005 |
| KR | 10-2005-0018182 | | 2/2005 |
| KR | 10-2005-0042127 | | 5/2005 |
| KR | 10-2005-0042128 | | 5/2005 |
| KR | 10-2005-0047281 | | 5/2005 |
| KR | 10-2004-0088884 | | 10/2005 |
| KR | 10-2006-0124222 | | 12/2006 |
| KR | 10-2006-0124224 | | 12/2006 |

* cited by examiner

*Primary Examiner* — Joseph L Perrin
(74) *Attorney, Agent, or Firm* — McKenna Long & Aldridge LLP

(57) ABSTRACT

A washing machine is disclosed. The washing machine has an improved structure adapted to generate steam in order to improve washing effect and enable sterilization of laundry using the steam. The washing machine comprises a tub to contain water, a heater installed in the tub, and a controller to control the heater to heat the water contained in the tub and to generate steam.

10 Claims, 7 Drawing Sheets

WASHING MACHINE GENERATING AND USING THE STEAM

This application claims the benefit of Korean Patent Application No. 2005-0046031, filed on May 31, 2005; No. 2005-0046032, filed on May 31, 2005 and PCT Application No. PCT/KR2006/001180, filed on Mar. 31, 2006, which is hereby incorporated by reference for all purposes as if fully set forth herein.

TECHNICAL FIELD

The present invention relates to a washing machine, and more particularly, to a washing machine adapted to generate and supply steam in order to enhance washing performance while enabling sterilization of laundry.

BACKGROUND ART

Generally, a washing machine can be classified into a pulsator type washing machine having a drum standing in a vertical direction, and a drum type washing machine having a drum lying in a horizontal direction.

Since the drum type washing machine lies in the horizontal direction, it performs washing operation in such a way of lifting and then dropping laundry within the drum.

FIGS. 1 and 2 schematically show a conventional drum type washing machine operated as mentioned above.

The drum type washing machine comprises a body 10, an outer tub 20 installed within the body 10, a drum 30 rotatably installed in the outer tub 20, a water supply pipe 50 to guide flow of water, and a driving unit to drive the drum 30.

Here, the body 10 is provided at a front side thereof with an input port 11 through which laundry is input to the body 10, and a door 40 attached to the input port 11 to open and close the input port 11.

The outer tub 20 has a damper 21, which is provided at either lower side around an outer periphery while being supported on an inner surface of the body 10.

The outer tub 20 is provided therein with a heater 80 on a bottom surface thereof to control the temperature of water used for washing the laundry.

The drum 30 is rotatably installed within the outer tub 20, and has a plurality of apertures 31 formed around an outer peripheral surface thereof such that water flows into and from the drum 30 therethrough.

The water supply pipe 50 is a passage through which the water for washing the laundry flows within the washing machine, and serves to guide the water supplied from a water pipe through a water supplying valve 51 into the outer tub 20.

Meanwhile, the washing machine further comprises a detergent storage part 52 at the passage of the water supply pipe 50 to store detergent required for washing operation such that the detergent is added to the water supplied into the outer tub 20.

The detergent storage part 52 is provided in an upper space inside the body 10, and is adapted to allow input of detergent.

In addition, a distal end of the water supply pipe 50 is connected with an upper end of the outer tub 20 at a front side thereof such that water gradually fills up the outer tub 20 and the drum 30 from the bottom surface thereof after natural fall of the water.

The driving unit comprises a driving motor 71 to drive the drum 30, and a belt 72 connected between the driving motor 71 and the drum 30 to transmit driving force of the driving motor 71 to the drum 30.

However, the conventional drum type washing machine as described above provides simple functions of washing and drying the laundry, and does not provide other functions.

Furthermore, even for a small amount of laundry or laundry with small amount of contaminants, the conventional drum type washing machine requires not only a great amount of water, but also substantially the same period of time as that for a general washing operation, causing unnecessary consumption of electricity.

Furthermore, although a controller of the washing machine serves to control the heater installed in the tub to warm the water, it does not serve to control the heater to generate steam. As a result, the conventional drum type washing machine cannot provide effect of washing the laundry with the steam. When considering that one method of enhancing washing effect is to increase the temperature of atmosphere around the laundry, it is insufficient for the conventional washing machine to enhance the washing effect only with warm water in the tub.

DISCLOSURE OF INVENTION

An object of the present invention devised to solve the problem lies on a washing machine, which has an improved structure adapted to generate and supply steam using a heater installed in a tub in order to improve washing effect, and on an installation structure of a water water level detection part applied to the washing machine to enable accurate detection for a level of water used for generating the steam.

The object of the present invention can be achieved by providing a washing machine, comprising: a tub to contain water; a heater installed in the tub; and a controller to control the heater to heat the water contained in the tub to generate steam.

Unlike the prior art, the heater is controlled not to warm water, but to generate steam by heating water.

Preferably, the washing machine further comprises a water level sensor to detect a water level in the tub, and the controller controls the heater according to a detection result of the water level sensor.

For example, when a very small amount of water is contained in the tub, it is desirable to stop the heater in order to prevent problems, which can occur due to overheating of the heater. In addition, it is possible to control an amount of steam by controlling the heater through detection of the water level using the water level sensor.

Preferably, the water level sensor detects the water level including a heater exposing level which is a level allowing the heater to be exposed from a surface of water. In addition, if it is determined that the detected water level is less than or equal to the heater exposing level, the controller controls the heater to be turned off.

Preferably, the water level sensor detects a higher water level above the heater exposing level. In addition, if it is determined that the water level is the higher level, the controller controls to stop water supply into the tub by turning off a water supplying valve, which is provided to the water supply passage.

The water level sensor may be adapted to detect a plurality of water levels higher than the heater exposing level. The controller can control the amount of steam with the plurality of higher water levels and the heater exposing level.

The amount of steam may be controlled with reference to a specific time. For example, the amount of steam can be controlled by controlling an operating time of the heater.

Preferably, the controller controls the heater to control the amount of steam with the method as described above. Here, the amount of steam can be selected by a user or can be preset to the controller according a kind of laundry.

For example, the washing machine may further comprise a selection button to control the amount of steam on a control panel to input a condition for washing the laundry, thereby allowing the user to select the amount of steam. Alternatively, the washing machine further comprises buttons to select the kind of laundry, such as general clothes, bedclothes, silks, etc., such that, when the kind of laundry is selected by the user, the controller controls the heater to generate a preset amount of steam corresponding to the selected kind of laundry. Here, preferably, an amount of laundry may be considered as a factor to control the heater.

Preferably, the water supply passage has an outlet port disposed adjacent to the heater. With this structure, it is possible to cool the heater by rapidly supplying the water to the heater through the outlet port if there can occur a problem of overheating.

If the outlet port of the water supply passage is apart from the heater, water discharged from the outlet port is absorbed into the laundry while flowing towards the heater, thereby preventing accurate detection of the water level, so that the amount of steam becomes inaccurate. Preferably, the heater is installed at a lower portion of the tub, and the outlet port is also located at the lower portion of the tub.

Here, the water supply passage may comprise a plurality of outlet ports through which the water is supplied into the tub. One of the outlet ports is located near the heater, while the other is located at an upper portion of the tub. Accordingly, the outlet port located at the upper portion of the tub is used for general water supply. In this regard, the water supplying valve is adapted to determine one outlet port among the plural outlet ports to discharge the water.

The water level sensor may comprise: a common electrode; a low level electrode to detect a low water level; and a high level electrode to detect a high water level.

When a water level reaches the low water-level and the water comes into contact with the low water-level sensor, the low water-level sensor is electrically connected with the common electrode via the water. In this manner, the water level can be detected via confirmation whether or not the low water-level sensor is electrically connected with the common electrode. At this time, the common electrode has its own terminal located below the low water-level sensor. The high water-level is also detected using the high water-level sensor in the similar manner to that described above.

Alternatively, instead of detecting the water level through confirmation of electrical connection therebetween, the water level can be detected with voltage variation occurring when the water level sensor comes into contact with the water.

The tub may comprise a storage part depressed in a concave shape from an inner surface of the tub to contain the water. Preferably, the heater is installed in the storage part. In addition, it is desirable that the outlet port of the water supply passage be located in the storage part in order to generate steam.

Although not being limited to this structure, the storage part may be located at the lower portion of the tub. In this manner, when the steam is generated by heating the water in the storage part as described above, it is possible to control an accurate amount of steam to be generated. Additionally, it is possible to enhance accuracy of detection for the water level.

Preferably, the water level sensor is installed through a bottom surface of the storage part. More preferably, the water level sensor is inserted through the bottom surface of the storage part while ensuring easy detachment therefrom. In addition, preferably, the water level sensor has a connector to which a coupler of the controller is detachably coupled.

Meanwhile, the washing machine may further comprise a circulation pump to draw the water from the tub and then to pump the water to an upper space of the tub. When the steam is generated and completely filled in the tub, the atmosphere in the tub is increased in temperature. At this time, a low surface temperature of the tub or the drum impedes the increase in temperature of the atmosphere. In addition, since the low surface temperature of the tub or the drum causes condensation of steam and results in dispersion of the steam, it cause low energy efficiency of the washing machine.

Accordingly, it is necessary to increase the temperature of the tub or the drum through circulation of hot water with the circulation pump. In addition, it is possible to increase swelling effect by circulating the water using the circulation pump while supplying the steam in a process of swelling the laundry.

More preferably, the washing machine further comprises a temperature sensor to detect an inner temperature of the tub. Thus, it is preferable to control supply of steam through confirmation of the temperature of the tub. For example, the steam may be supplied until the temperature of the tub is increased to a preset temperature. Alternatively, the steam may be supplied into the tub so as to maintain the temperature of the tub for a predetermined period of time.

Another aspect of the present invention provides a method for controlling a washing machine, the washing machine comprising a tub, a heater installed inside the tub, and a water level sensor to detect a high level L1 and a low level L2 of water in the tub, the method comprising the steps of: supplying water to the high level into the tub until it is determined by the water level sensor that the water reaches the high level in the tub; and generating steam by controlling the heater until it is determined by the water level sensor that the water reaches the low level in the tub.

When multiple high levels are set in the tub, it is possible to control an amount of steam.

The step of supplying the water to the high level may comprise supplying the water into the tub at an initial stage; detecting a water level in the tub by using the water level sensor; and additionally supplying the water into the tub if it is determined that the detected water level is lower than the high level, discharging the water if it is determined that the detected water level is higher than the high level, or stopping water supply if it is determined that the detected water level is the same as the high level.

Since generation of steam with an excessive amount of water requires unnecessary consumption of energy, it is desirable to reduce the amount of water through discharge of water.

In addition, if water is discharged through the outlet port of the water supply passage located at the upper portion of the tub, a portion of water is absorbed into the laundry so that steam is generated using a smaller amount of water than a supplied amount of water. Accordingly, in this case, it is necessary to adjust the amount of water used to generate the steam to a preset amount by additional supplying the water. In addition, since the amount of water contained in the laundry varies according to a kind or an amount of laundry, it is necessary to perform additional water supplying operation after confirming an initial amount of water supplied in the tub in order to supply an accurate amount of steam.

Preferably, a drum of the washing machine is controlled to rotate at the initial water supplying step. If the laundry is completely soaked with the water during the initial water supplying step, it is possible to enhance the swelling effect while allowing the newly supplied water to be directly used for generating the steam without being absorbed into the laundry. Accordingly, it is possible to determine the amount of water to be used for generating the steam by a single additional water supply.

The steam generating step may comprise detecting the water level by using the water level sensor; and controlling the heater to continue generation of steam if it is determined that the detected level of water is higher than the low level.

As apparent from the above description, the present invention has an advantageous effect in that, as the washing machine is structured to supply steam, it is possible to enhance efficiency of washing laundry by using the steam. For example, the steam increases the temperature of atmosphere in the drum or the tub, thereby enhancing the washing effect. The increased temperature of the atmosphere prevents hot water from being rapidly cooled, thereby enhancing energy efficiency of the washing machine.

The washing machine has an additional advantageous effect in that, since the steam having a high temperature is supplied to the laundry, the laundry is sterilized by the steam.

In particular, since the water level sensor is installed through the bottom surface of the storage part to detect the level of water supplied into the storage part, it is possible to increase accuracy in detection of the water level.

Additionally, the washing machine of the present invention can obtain enhanced swelling effect and efficient use of energy through circulation of water with the circulation pump.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
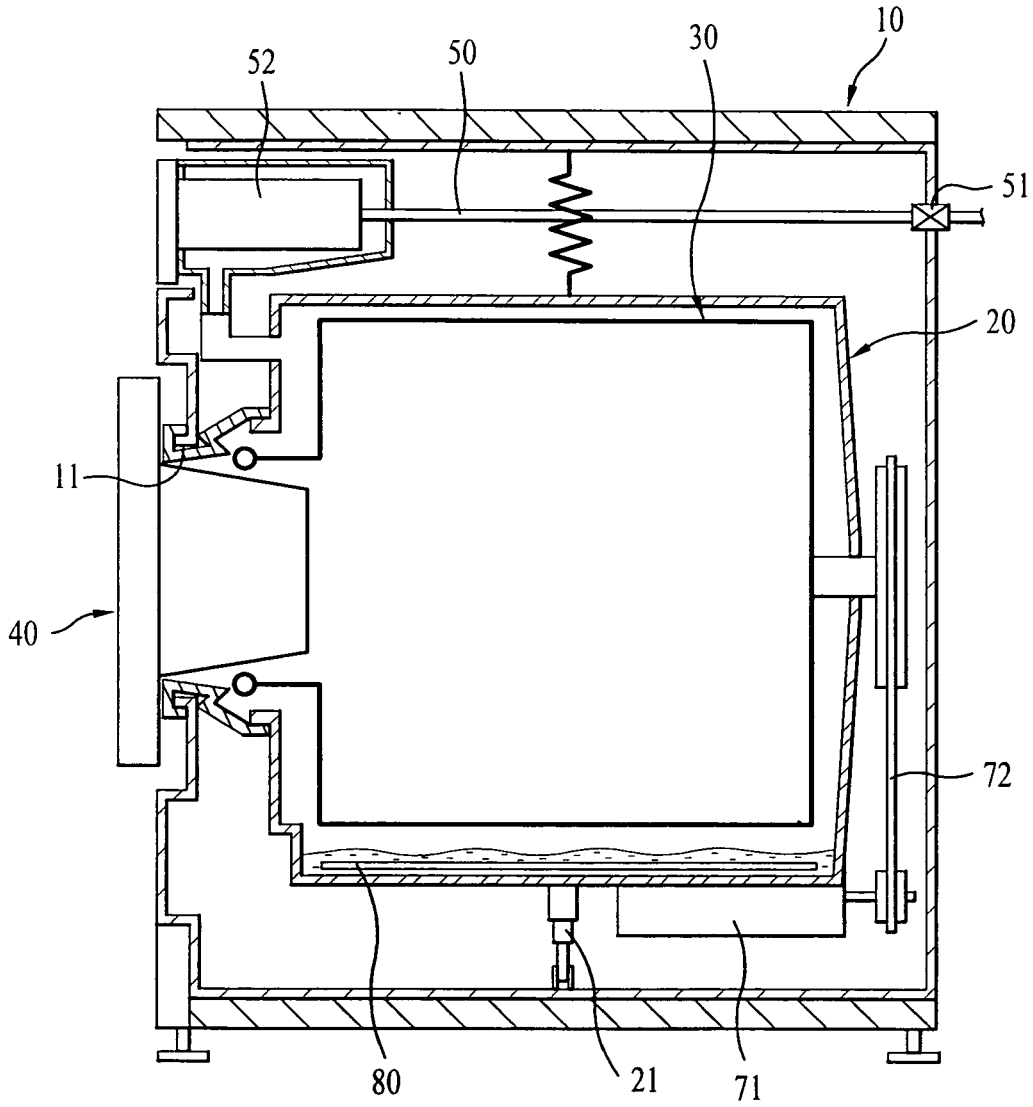
FIG. 1 is a side elevation illustrating an inner structure of a conventional drum type washing machine.
Figure 2:
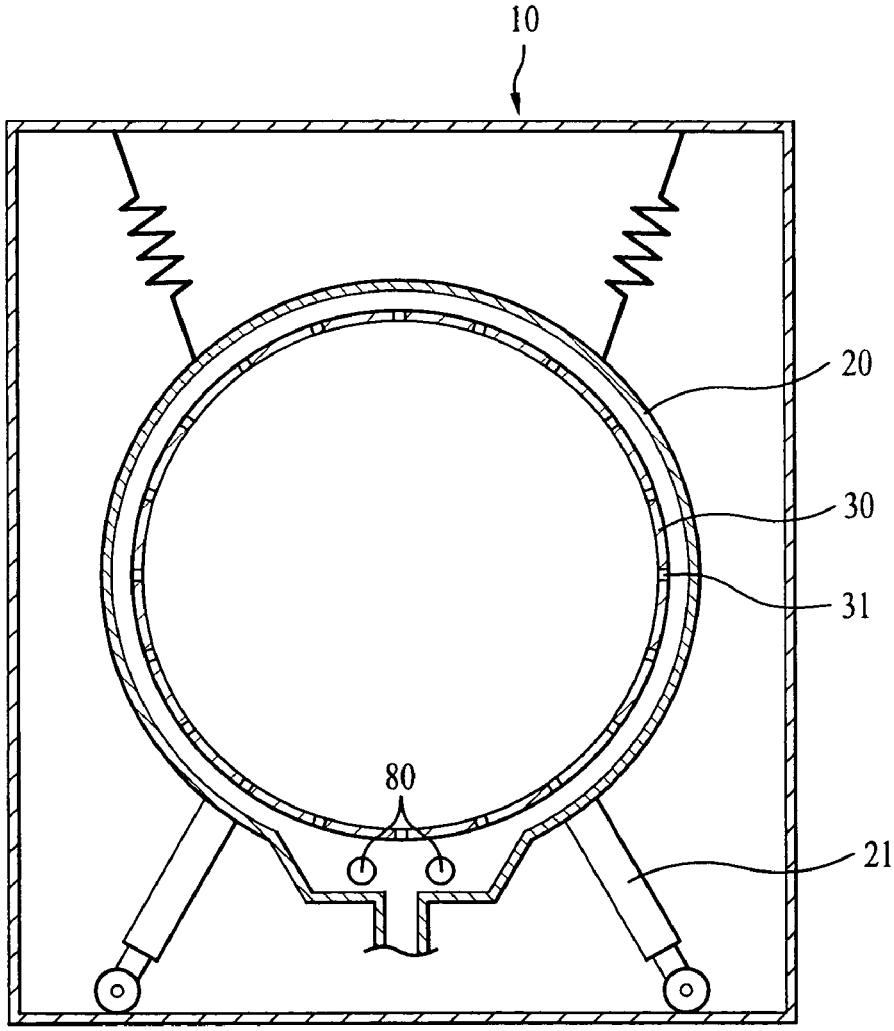
FIG. 2 is a front elevation illustrating the inner structure of the conventional drum type washing machine.
Figure 3:
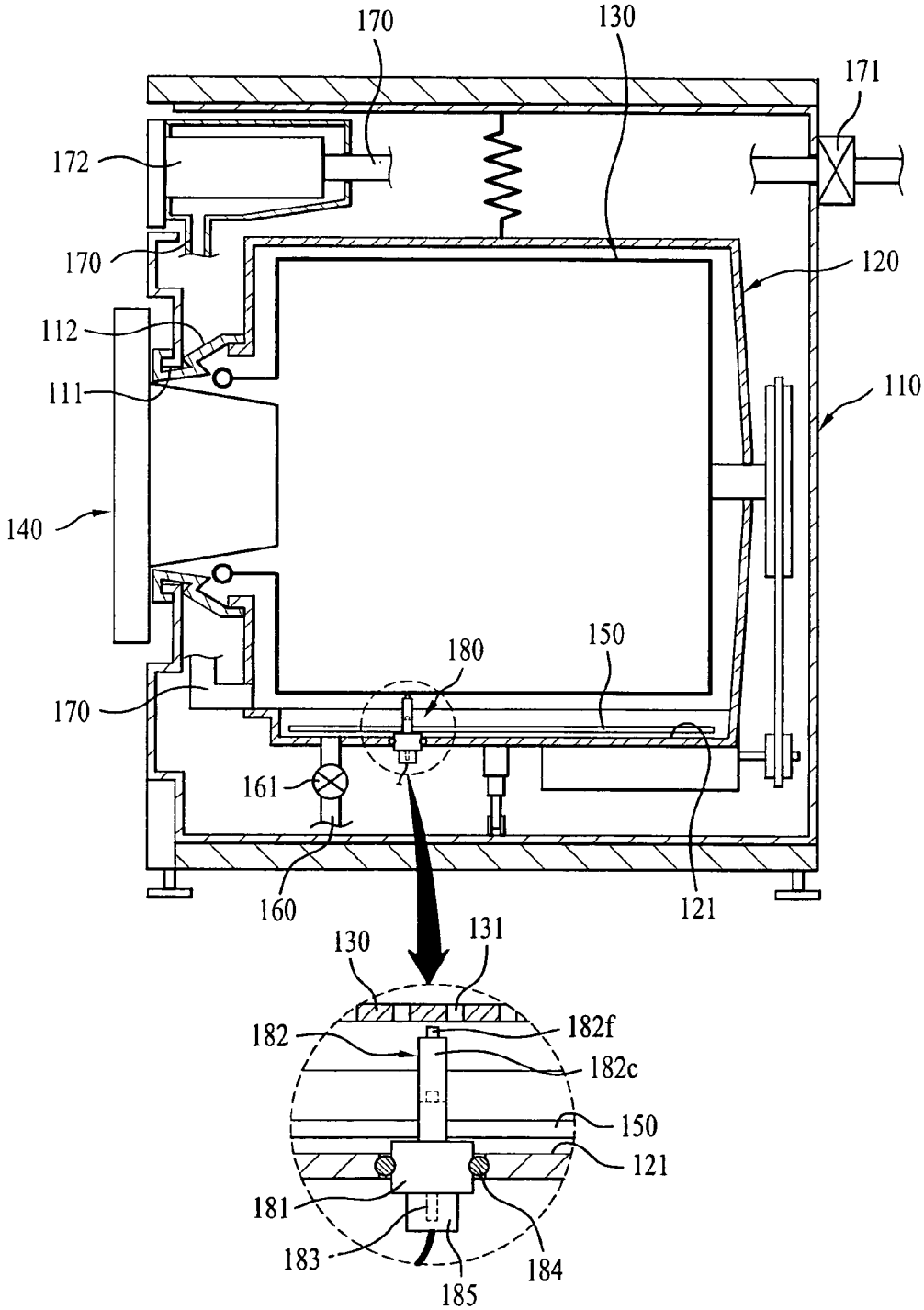
FIG. 3 is a side elevation illustrating an inner structure of a drum type washing machine in accordance with a first embodiment of the present invention.
Figure 4:
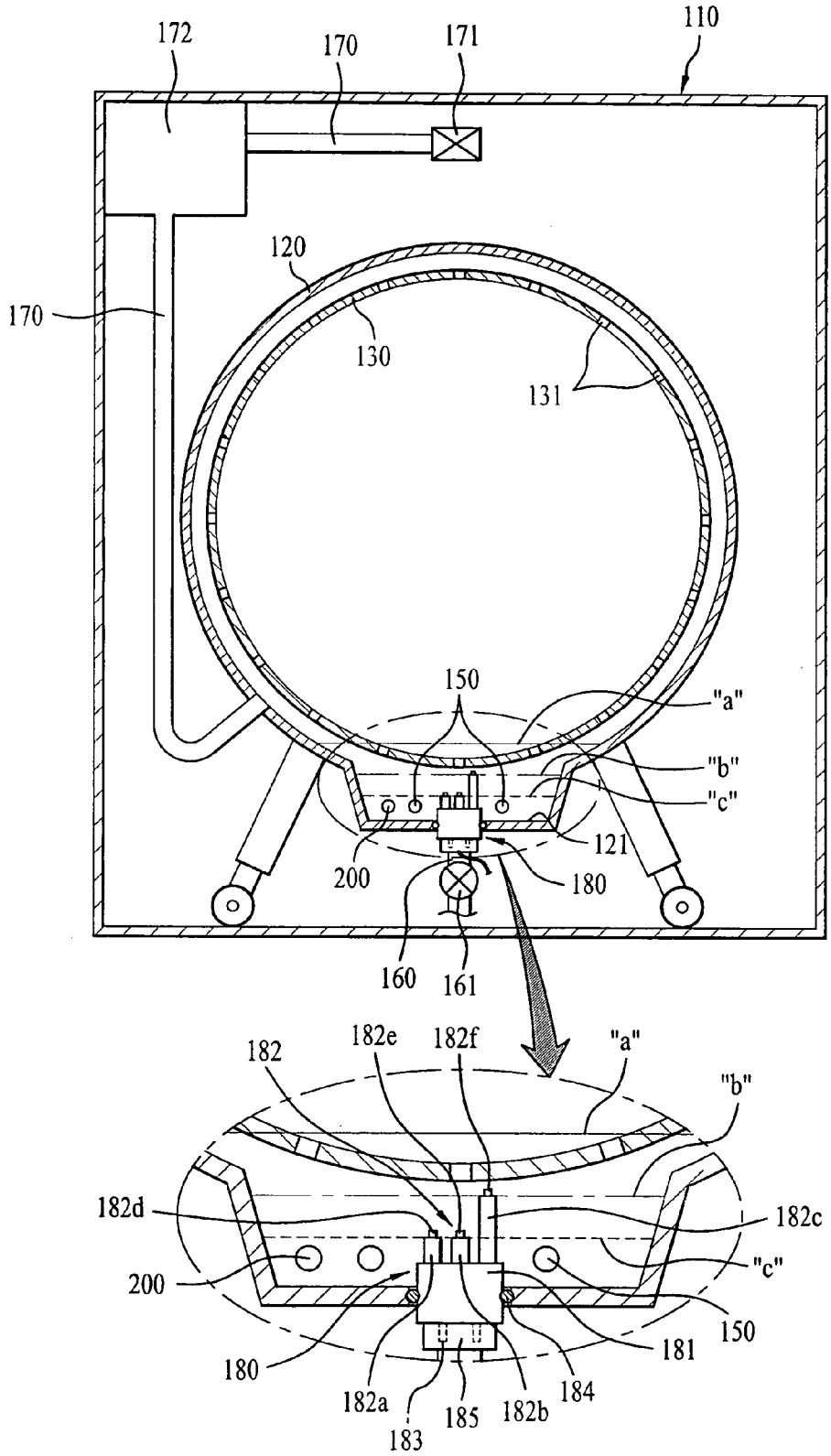
FIG. 4 is a front elevation illustrating the inner structure of the drum type washing machine in accordance with the first embodiment of the present invention.

Referring to FIGS. 3 and 4, a washing machine according to an embodiment of the present invention generally comprises a body 110, an outer tub 120, a drum 130, a heater 150, a water supply pipe 170, a water level detection part 180, and a controller (not shown).

The body 110 defines an appearance of the washing machine.

The body 110 is formed at a front side thereof with an input port 111, and comprises a door 140 mounted thereon to open and close the input port 111.

The outer tub 120 is provided in the body 110 in a state of being supported in the body.

The outer tub 120 has a storage part 121 defined in a bottom space thereof to store a predetermined amount of water.

The storage part 121 is protruded downwardly from the center of a peripheral surface of the outer tub 120.

The storage part 121 is connected with a drainage pipe 160 to drain water to an outside of the washing machine. The drainage pipe 160 is provided with a drainage valve 161 to open and close a passage through which the water is discharged to the outside.

The drum 130 is rotatably installed in the outer tub 120. The drum 130 has an opening facing the input port 111 of the body 110.

A rim 112 is provided between the input port 111 and the drum 130 to block a space to input laundry into the drum from a space within the body 110.

The drum 130 has a plurality of apertures 131 formed around a peripheral surface thereof. Water and steam is introduced into the drum 130 through the apertures.

The heater 150 is installed along an inner surface of the storage part 121 within the outer tub 120 to heat water supplied to the storage part.

Preferably, the body 110 is further provided with a temperature detection part 200 to detect an inner temperature of the outer tub 120.

Most preferably, the temperature detection part 200 is provided in the storage part 121 of the outer tub 120.

The temperature detection part 200 is constituted by a typical thermistor or a typical thermostat, and is operated to cut off power to the heater 150 if the heater 150 is overheated.

The water supply pipe 170 is a passage through which water flows within the washing machine, and serves to guide water supplied from a water pipe through a water supplying valve 171 into the outer tub 120.

The washing machine further comprises a detergent storage part 172 at a passage of the water supply pipe 170 to store detergent required for washing operation such that the detergent is added to the water supplied into the outer tub 120.

The detergent storage part 172 is provided in an upper space inside the body 110, and is adapted to allow input of detergent.

According to the embodiment of the present invention, the water supply pipe 170 has an outlet port connected with a portion adjacent to the heater 150 around the bottom surface of the outer tub 120, that is, a portion of the outer tub 120 where the storage part 121 is formed.

This structure is devised in order to solve the problem of the prior art in that, if water is supplied into the washing machine via the structure of the prior art, the water is absorbed into laundry before being stored in the storage part 121 of the outer tub 120.

That is, in the prior art, as the water is absorbed into the laundry, it is difficult to supply an accurate amount of water to the storage part 121, which in turn makes it difficult to detect a level of the water stored in the storage part 121 with accuracy. On the contrary, according to the embodiment of the present invention, the water supply pipe is adapted to allow the water to be directly supplied to the storage part 121 without passing the laundry.

The water level detection part 180 is coupled to the outer tub 120 through the storage part 121, and detects a level of the water within the storage part 121.

Specifically, the water level detection part 180 is preferably coupled to the storage part 121 through a center of the bottom surface of the storage part 121 so as not to intervene a portion with which the drainage pipe 160 is connected. Of course, the water level detection part 180 may be located within the drainage pipe 160.

The water level detection part 180 comprises a coupling part 181, an electrode part 182, and a jack 183.

The coupling part 181 is a part which penetrates the storage part 121, and is mounted to the storage part 121.

In this regard, the coupling part 181 is provided with a sealing member 184 around a peripheral surface thereof in order to seal a gap formed between the coupling part 181 and the storage part 121.

As shown in the drawing, the sealing member 184 may be a typical O-ring. Alternatively, although not shown in the drawings, the sealing member 184 may be a rubber film stepped at a portion which will engage with the storage part.

The electrode part 182 comprises at least three electrodes 182*a*, 182*b* and 182*c* such that the water level can be confirmed by supplying a voltage, which is changed according to variation in electrical connection between the respective electrodes 182*a*, 182*b* and 182*c*, to the controller (not shown).

Here, the electrodes 182*a*, 182*b* and 182*c* of the electrode part 182 comprises a single common electrode 182*a*, a single low level confirmation electrode 182*b*, and a single high level confirmation electrode 182*c*. Distal ends of the respective electrodes 182*a*, 182*b* and 182*c* are provided with terminals 182*d*, 182*e* and 182*f* exposed to surrounding (that is, an inner space of the storage part 121), respectively. Each of the electrodes 182*a*, 182*b* and 182*c* is surrounded by a dielectric and water-proof film excluding the exposed terminals 182*d*, 182*e* and 182*f*.

At this time, the terminal 182*d* of the common electrode 182*a* is located higher than the heater 150, and the terminal 182*e* of the low level confirmation electrode 182*b* is located substantially the same height as that of the terminal 182*d* of the common electrode 182*a*.

Preferably, the terminal 182*d* of the common electrode 182*a* and the terminal 182*e* of the low level confirmation electrode 182*b* are located at a height, which is approximately the same as a preset minimum water level required for generation of steam while allowing the heater 150 to be immersed in the water.

In addition, the terminal 182*f* of the high level confirmation electrode 182*c* is located at a height, which is approximately the same as a preset maximum water level required for generation of steam above the terminal 182*d* of the common electrode 182*a* and the terminal 182*e* of the low level confirmation electrode 182*b*.

Such structure of the respective electrodes 182*a*, 182*b* and 182*c* of the electrode part 182 is devised to prevent the heater 150 from being exposed to atmosphere while preventing the level of water supplied to the storage part 121 of the outer tub 120 from exceeding a preset level.

The jack 183 is a part to which a coupling jack 185 is coupled to supply a detection value supplied from the respective electrodes 182*a*, 182*b* and 182*c* of the electrode part 182 to the controller.

The controller (not shown) controls selective operation of the water supplying valve 171 based on the value detected by the water level detection part 180, heating of the heater 150 based on the detected level of the water, and driving of the drum 130.

At this time, the controller recognizes a current water level through continuous confirmation of electrical connection between the common electrode 182*a* and the other electrodes 182*b* and 182*c* of the water level detection part 180, and controls operation of the water supplying valve 171 and the heater 150 based on the current water level.

The water level can be recognized in various manners.

According to one embodiment of the present invention, the controller receives a value (for example, voltage) detected by the water level detection part 180, and compares the detection value with a predetermined reference value, thereby recognizing the water level. At this time, the detection value is converted into digital data for comparison with the reference value.

If a digital value converted from the detection value is higher than the reference value, the terminals 182*d*, 182*e* and 182*f* of the electrodes 182*a*, 182*b* and 182*c* are in a state of being exposed from the water. On the contrary, if the value converted from the detection value is lower than the reference value, the terminals 182*d*, 182*e* and 182*f* of the electrodes 182*a*, 182*b* and 182*c* are in a state of being immersed in the water.

Figure 5:
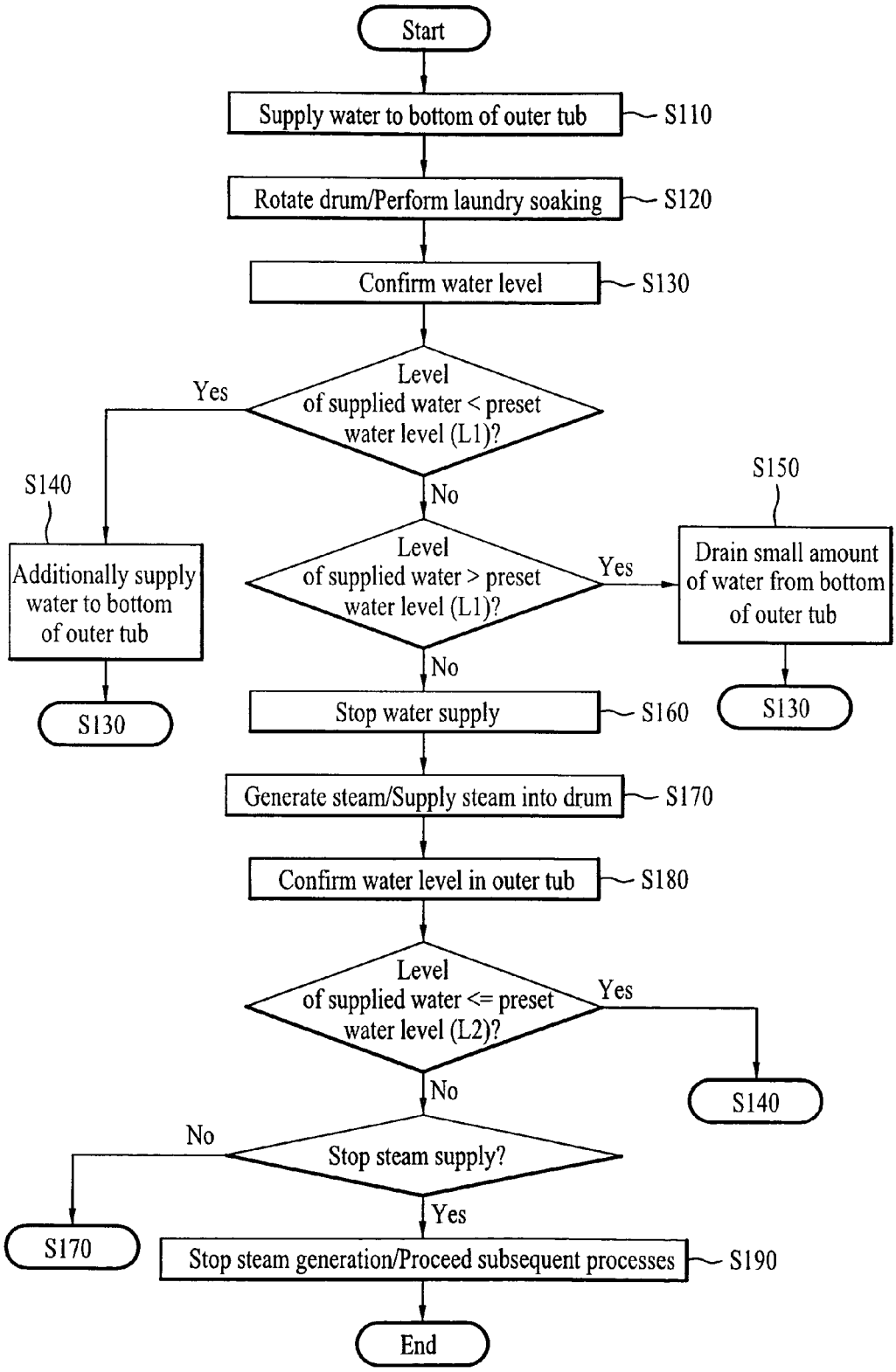
FIG. 5 is a flow diagram schematically illustrating a process of controlling the washing machine in accordance with the first embodiment of the present invention.

A method of washing laundry using the washing machine according to the embodiment will be described with reference to FIGS. 4 and 5.

According to the embodiment of the present invention, the method of washing the laundry generally comprises a water supplying step, a laundry soaking step, a water re-supplying step, and a steam supplying step, which will be sequentially described hereinafter.

At first, the controller to control washing operation of the washing machine can receive continuous request from a user to perform the washing operation.

If there is a request for washing operation, the water supplying step is performed in such a way that a controller controls the water supplying valve 171 to supply water to the bottom of the outer tub 120 (S110).

Then, the water flows through the water supply pipe 170 opened by the water supplying valve 171, is supplied into the outer tub 120 through a bottom space of the body 110, and fills up from the outer tub 120 the storage part 121. Since the outlet port of the water supply pipe 170 is connected with the lower side of the outer tub 120 around the peripheral surface thereof, the water does not soak the laundry within the drum 130 while being supplied to the outer tub.

In addition, the water is supplied into the tub to a such a degree that the bottom of the drum 130 is immersed in the water, and has a level (denoted by reference mark "a" in the drawing) which allows the laundry on the bottom of the drum 130 to be soaked therewith when the drum 130 is rotated.

Although confirmation of the water level can be performed by the water level detection part 180, when considering that the water level detection part 180 is used for generation of steam, it is desirable to perform the confirmation of the water level by using a separate sensor suitable to detect the water level or by measuring a period of time for which water is supplied.

If the water is supplied to the level set by the process as described above, the controller controls the water supplying valve 171 to stop supply of water.

After completing the water supplying step as described above, the controller performs the laundry soaking step.

The laundry soaking step is a process to soak the laundry with the water by continuously rotating the drum 130 (by rotating in one direction or by alternating in right and left directions) (S120).

In other words, the laundry within the drum 130 is moved by rotation of the drum 130, and soaked with the water present on the bottom surface of the drum 130.

The laundry soaking step continues for a preset period of time.

After completing the laundry soaking step, the controller performs the water re-supplying step.

The water re-supplying step is a process to supply water required for generation of steam to a preset level.

Since the water level is rapidly reduced in the laundry soaking step, the amount of water actually used to generate steam becomes insufficient, and thus it is necessary to perform this step.

The water re-supplying step comprises confirming the water level through control of the water level detection part 180 (S130), and is performed by selectively controlling the water supplying valve 171 according to the confirmed water level.

Confirmation of the water level is performed in such a way of comparing a detection value supplied from the high level confirmation electrode 182*c* of the water level detection part 180 with a preset reference value, and confirming whether or not a current water level is lower than a preset maximum level L1.

If it is determined that the detection value is higher than the reference value due to electrical disconnection between the common electrode 182*a* and the respective terminals 182*d* and 182*f* of the high level confirmation electrode 182*c*, the controller controls the water supplying valve 171 to perform the water re-supplying step.

If it is determined that the detection value of the high level confirmation electrode 182*c* supplied from the water level detection part 180 is higher than the reference value, the controller controls the water supplying valve 171 to additionally supply water into the outer tub 120 through the water supply pipe 170 (S140).

While the water is supplied to the outer tub 120, the controller receives the detection value of the high level confirmation electrode 182*c* supplied from the water level detection part 180, and determines a time for stopping water supply by comparing the detection value with the reference value.

At this time, since the water is directly supplied to the bottom of the outer tub 120 without passing through the laundry, it is possible to determine the time for stopping the water supply with accuracy.

In other words, it is possible to prevent error in detection of water level due to absorption of water into the laundry, which can occur when the water passes through the laundry in the prior art.

Meanwhile, when confirming the level of the water used for generating the steam after the laundry soaking step and before the water re-supplying step, there may occur a case where the detection value supplied from the high level confirmation electrode 182*c* is lower than the preset reference value.

This case can occur when the water supplied for the laundry soaking step is excessive.

Accordingly, if the water level exceeds the preset maximum level L1, it is desirable to control the drainage valve 161 to drain a small amount of water from the storage part 121 through the water drainage pipe 160.

In other words, since an excessive amount of water supplied into the storage part 121 inevitably increases power consumption to evaporate the water, it is most desirable to provide a suitable level of water into the storage part.

In addition, when the water is supplied in such an amount that a level of the water contained in the storage part 121 of the outer tub 120 reaches a height (denoted by reference mark "b" in the drawing), which is set to the maximum level required to generate the steam, the controller stops water supply (S160).

Then, the steam supplying step is performed to generate and supply steam into the drum 130 (S170). At this time, a detection value of the high level confirmation electrode 182*c* is lower than the reference value.

The steam is generated via heat generation of the heater 150.

That is, when the controller controls the heater 150 to generate heat, the water in the storage part 121 evaporates, and generates steam having a high temperature.

Additionally, the steam of the high temperature rises from the bottom space within the outer tub, and flows into the drum 130 through the apertures 131 of the drum 130.

As a result, laundry within the drum 130 is supplied with the steam of the high temperature, which enables separation and sterilization of contaminants.

In particular, when considering that the steam is supplied to the laundry while rising from the bottom surface of the drum 130, the laundry is washed and sterilized in, for example, a smothering manner.

At this time, it is more preferable to control the drum 130 to rotate and cause the steam to be uniformly supplied to all the laundry within the drum 130.

In addition, while performing the steam supplying step as described above, the controller continues to confirm the water level in the storage part 121, which is a level of the water on the bottom of the outer tub 120, in such a way of receiving a detection value supplied from the low level confirmation electrode 182*b* of the water level detection part 180, and comparing the detection value with the reference value (S180).

This step is required for the purpose of preventing the water level in the storage part 121 from being lowered below a preset minimum level L2 (approximately the same as a height of the heater denoted by reference mark "c" in the drawing).

At this time, if it is determined that the detection value supplied from the low level confirmation electrode 182*b* is higher than the reference value, the controller controls the heater 150 to stop heat generation, and controls the water supplying valve 171 to additionally supply water into the storage part 121 (S140).

When additionally supplying the water, the time for stopping the water supply is determined by comparison of a detection value supplied from the high level confirmation electrode 182*c* with the reference value.

When the steam supplying step is finished, the steam is not generated any more, and post-processes, such as a washing process, a rinsing process, and a spin-drying process, are sequentially performed (S190).

Figure 6:
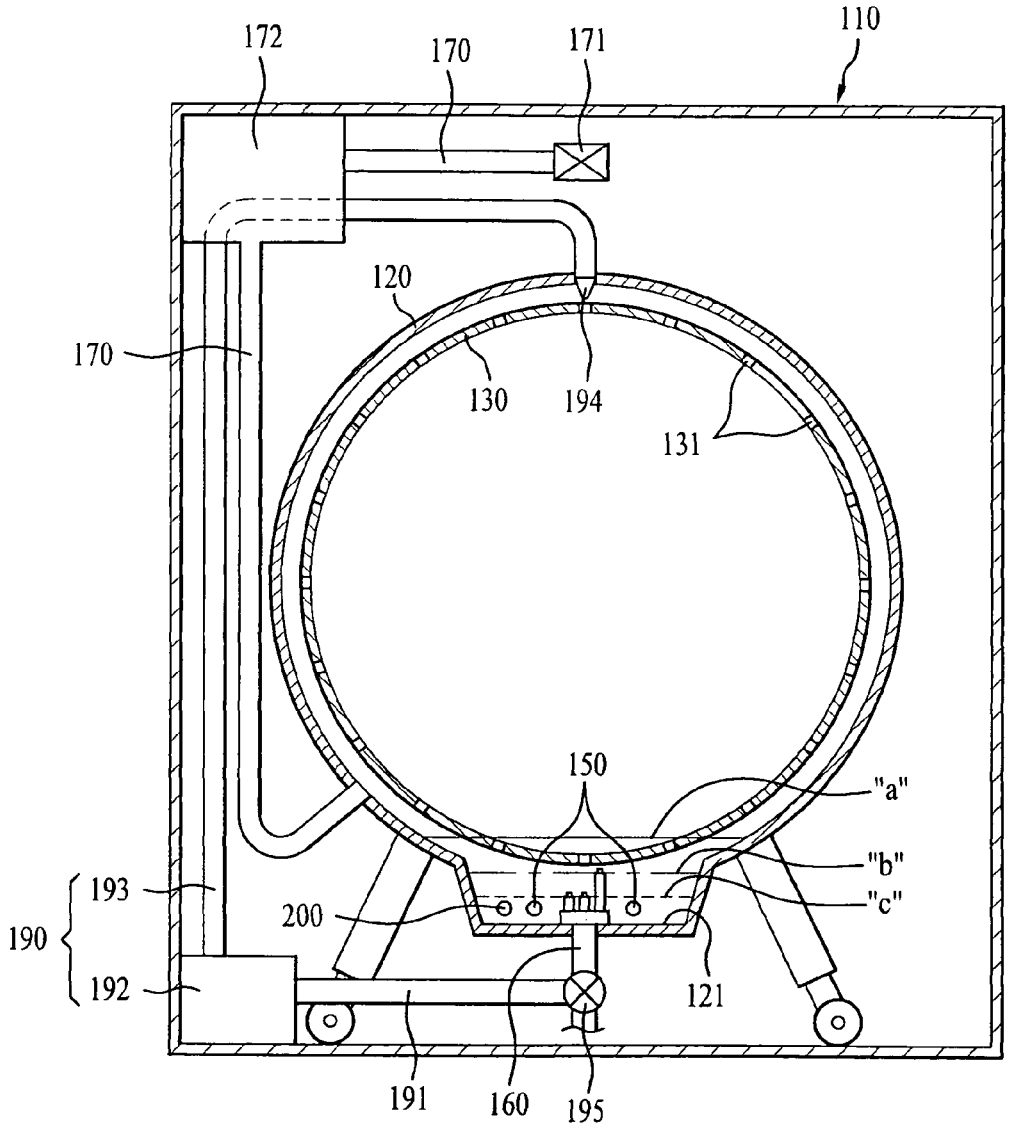
FIG. 6 is a front elevation illustrating an inner structure of a drum type washing machine in accordance with a second embodiment of the present invention.

FIG. 6 shows a drum type washing machine in accordance with a second embodiment of the present invention.

According to the second embodiment, the washing machine comprises a water circulation part 190 in addition to the components of the first embodiment.

The water circulation part 190 is adapted to inject water into a drum 130 while circulating the water supplied into an outer tub 120, thereby allowing operation of soaking laundry to be performed efficiently.

The water circulation part 190 comprises an inlet pipe 191 to receive water supplied from the outer tub 120, a circulation pump 912 provided on the inlet pipe 191 to pump the water, a guide pipe 193 to guide the water pumped by the circulation pump 192 into an upper space within the body 110, and an injection nozzle 194 coupled to an outlet of the guide pipe 193 and penetrating the rim 112 so as to be communicated with an inner upper end of the drum 110 to inject the water into the drum.

Preferably, the inlet pipe 191 is communicated with a drainage pipe 160. A valve 195 is provided to either the inlet pipe 191 or the drainage pipe 160 to selectively open and close the inlet pipe 191 and the drainage pipe 160.

Figure 7:
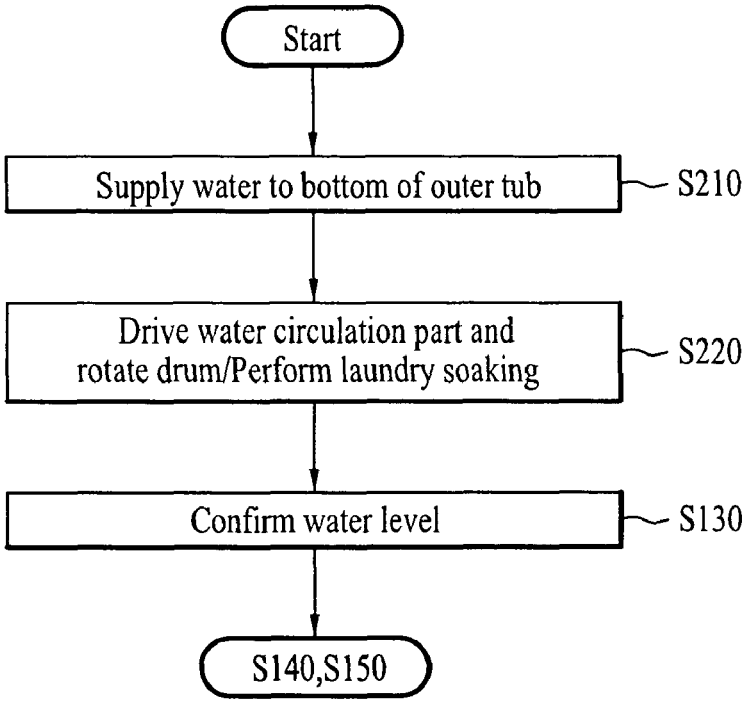
FIG. 7 is a flow diagram schematically illustrating a process of controlling the washing machine in accordance with the second embodiment of the present invention.

A method of washing laundry using the washing machine according to the second embodiment will be described with reference to FIG. 7.

According to the second embodiment of the present invention, the method of washing the laundry generally comprises a water supplying step, a laundry soaking step, a water re-supplying step, and a steam supplying step, which will be sequentially described hereinafter.

The water supplying step of the second embodiment is the same as that of the first embodiment as described above. That is, the water supplying step is performed in such a way that a controller controls a water supplying valve 171 to supply water to the bottom of the outer tub 120 (S210).

After completing the water supplying step as described above, the laundry soaking step is performed, in which laundry is soaked with water.

According to the second embodiment, the laundry soaking step is performed through control of the water circulation part 190 (S230) unlike the first embodiment.

Specifically, when the circulation pump 192 is driven by the controller, the water is pumped from the outer tub 120 through the inlet pipe 191, flows along the guide pipe 193, and is injected into the drum 130 through the injection nozzle 194.

As a result, the laundry is soaked with the water injected through the injection nozzle 194 within the drum 130.

Of course, it is more preferable that the drum 130 continuously rotates (rotates in one direction or alternates in right and left directions) to soak the laundry with the water injected through the injection nozzle 194 more efficiently.

After completing the laundry soaking step as described above, a water level of the outer tub 120 is confirmed (S130), and then a series of steps such as the water re-supplying step and the steam supplying step of the first embodiment are performed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention relates to a washing machine, and more particularly, to a washing machine adapted to generate and use steam in order to enhance washing performance while enabling sterilization of laundry.

As apparent from the above description, the washing machine according to the present invention has an advantageous effect in that the washing machine is adapted to supply steam, thereby enhancing performance of washing laundry using the steam.

The washing machine has an additional advantageous effect in that, since the steam having a high temperature is supplied to the laundry, the laundry is sterilized by the steam.

In particular, since the water level sensor is installed through the bottom surface of the storage part of the tub, and detects a level of water supplied into the storage part, it is possible to increase accuracy in detection of the water level.

Additionally, the washing machine of the present invention can obtain enhanced swelling effect and efficient use of energy through circulation of water using the circulation pump.

What is claimed is:

1. A washing machine, comprising:

a tub for containing water;

a storage part depressed in a concave shape from an inner surface of the tub to contain the water;

a drum;

a heater installed in the storage part;

a water supplying valve;

a water level sensor installed in the tub to detect a water level;

a circulation pump connected with the storage part to draw the water from the tub and then to pump the water to an upper space of the tub; and a controller for controlling the heater according to a detection result by the water level sensor so as to heat the water in the tub and generate steam for washing laundry and controlling the circulation pump, wherein the controller controls the water supplying valve to supply water up to a water level which allows laundry on the bottom of the drum to be soaked for soaking the laundry ("a" level) and below the water level for generating steam ("b") level) and wherein the controller controls the heater and the circulation pump in a process of swelling the laundry to heat the water by using the heater and circulate the hot water heated by the heater to the tub by using the circulation pump and then supplying the steam generated by the heater to the tub.

2. The washing machine according to claim 1, wherein the heater is exposed in the tub, the water level sensor detects a heater exposing level at which the heater is exposed from a surface of the water, and the controller controls the heater to be turned off if it is determined that the detected water level is less than or equal to the heater exposing level.

3. The washing machine according to claim 2, wherein the water level sensor detects a high water level higher than at least the heater exposing level, and the controller controls to close the water supplying valve if it is determined that the water level is the high level or higher.

4. The washing machine according to claim 3, wherein the passage of water has an outlet through which the water is discharged into the tub, the outlet being located near the heater.

5. The washing machine according to claim 1, wherein the water level sensor comprises a common electrode, a low level electrode to detect a low water level, and a high level electrode to detect a high water level.

6. The washing machine according to claim 1, further comprising: a temperature sensor to detect an inner temperature of the tub.

7. The washing machine according to claim 1, wherein the water level sensor is installed through a bottom surface of the storage part, and is provided at one side with a connector to which a connector of the controller is detachably connected.

8. The washing machine according to claim 7, wherein the water level sensor comprises a common electrode, a low level electrode to detect a low water level, and a high level electrode to detect a high water level.

9. The washing machine according to claim 1, wherein the passage of water has an outlet through which the water is discharged into the tub, the outlet being located in the storage part.

10. The washing machine according to claim 1, wherein the controller controls the heater to control an amount of steam according to a washing condition.

* * * * *